US008821055B2

(12) United States Patent
Ukai

(10) Patent No.: US 8,821,055 B2
(45) Date of Patent: Sep. 2, 2014

(54) IMAGE FORMING APPARATUS

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 175 days.

(21) Appl. No.: 13/431,068

(22) Filed: Mar. 27, 2012

(65) Prior Publication Data

US 2012/0251201 A1 Oct. 4, 2012

(30) Foreign Application Priority Data

Mar. 29, 2011 (JP) ..... 2011-071979

(51) Int. Cl.
*B41J 29/02* (2006.01)
*G03G 15/00* (2006.01)

(52) U.S. Cl.
USPC ..... 400/693; 399/397; 399/405

(58) Field of Classification Search
CPC ..... G03G 21/203; B41J 29/377
USPC ..... 399/397, 405; 400/693
See application file for complete search history.

(56) References Cited

U.S. PATENT DOCUMENTS

| | | | | |
|---|---|---|---|---|
| 7,354,213 | B2 * | 4/2008 | Iwata et al. | 400/693 |
| 2003/0185584 | A1 | 10/2003 | Hirose et al. | |
| 2008/0187349 | A1 * | 8/2008 | Yoshihara et al. | 399/92 |
| 2009/0269113 | A1 | 10/2009 | Ogawa | |
| 2010/0054791 | A1 * | 3/2010 | Shimizu | 399/92 |
| 2011/0217066 | A1 | 9/2011 | Ukai | |

FOREIGN PATENT DOCUMENTS

| | | | |
|---|---|---|---|
| JP | 02300771 | A * | 12/1990 |
| JP | H03-217861 | A | 9/1991 |
| JP | H06-18798 | A | 1/1994 |
| JP | 06-138786 | | 5/1994 |
| JP | 06-186873 | | 7/1994 |
| JP | 06-239490 | | 8/1994 |
| JP | 08-217288 | | 8/1996 |
| JP | H10-235966 | A | 9/1998 |
| JP | 2002-137493 | A | 5/2002 |
| JP | 2002-325212 | A | 11/2002 |
| JP | 2003-287996 | | 10/2003 |

(Continued)

OTHER PUBLICATIONS

JP Office Action mailed Jul. 16, 2013, JP Appln. 2011-071979, English translation.

(Continued)

*Primary Examiner* — Daniel J Colilla
*Assistant Examiner* — John M Royston
(74) *Attorney, Agent, or Firm* — Banner & Witcoff, Ltd.

(57) ABSTRACT

An image forming apparatus includes a main body, an image forming unit, a fixing unit, a first feed path forming member, and an ejection portion. The first feed path forming member is disposed between the image forming unit and the fixing unit in the main body and forms a first feed path in which a transferring member is fed. The ejection portion includes a tray member disposed at an upper end portion of the main body and including a communication opening that provides communication between an inside and an outside of the main body. The communication opening is disposed between the image forming unit and the fixing unit in a plan view. The first feed path forming member includes a first through hole. The first through hole is open toward the communication opening and the communication opening is open toward the first through hole.

9 Claims, 9 Drawing Sheets

(56) References Cited

FOREIGN PATENT DOCUMENTS

| | | | |
|---|---|---|---|
| JP | 2005-037732 | A | 2/2005 |
| JP | 2005-049592 | A | 2/2005 |
| JP | 2005-215182 | A | 8/2005 |
| JP | 2005-239390 | A | 9/2005 |
| JP | 2009-263103 | | 11/2009 |
| JP | 2011-209703 | | 10/2011 |

OTHER PUBLICATIONS

CN First Office Action mailed Jun. 5, 2014, CN Appln. 201210088513.3, English translation.

* cited by examiner

IMAGE FORMING APPARATUS

CROSS REFERENCE TO RELATED APPLICATION

This application claims priority from Japanese Patent Application No. 2011-071979, filed on Mar. 29, 2011, the content of which is incorporated herein by reference in its entirety.

TECHNICAL FIELD

Aspects of the disclosure relate to an electrophotographic image forming apparatus.

BACKGROUND

As an electrophotographic image forming apparatus, a laser printer is known. The laser printer may include, in a main body, a process cartridge that includes a photosensitive drum and transfers a toner image carried on the photosensitive drum onto a recording sheet fed from a sheet supply tray, and a fixing unit that fixes the toner image transferred onto the recording sheet by heat.

In the laser printer, when a user accidentally spills a liquid on the image forming apparatus from above, the liquid may enter the main body from joints of the main body.

If the liquid enters the main body, the process cartridge and the fixing unit may get wet, electrically shorted, and then go out of order.

SUMMARY

Aspects of the disclosure may provide an image forming apparatus that reduces the potential of a process cartridge and a fixing unit from getting wet when a liquid is spilled on an upper portion of the image forming apparatus.

According to an aspect of the disclosure, an image forming apparatus comprises a main body, an image forming unit, a fixing unit, a first feed path forming member, and an ejection portion. The image forming unit is disposed in the main body and configured to form an image on a transferring member. The fixing unit is configured to fix the image onto the transferring member. The first feed path forming member is disposed between the image forming unit and the fixing unit in the main body, and forms a first feed path along which the transferring member is fed. The ejection portion is configured to eject the transferring member on which the image is fixed at the fixing unit out of the main body. The ejection portion includes a tray member. The tray member is disposed at an upper end portion of the main body and configured to receive the transferring member ejected therein. The tray member has a communication opening that provides communication between an inside and an outside of the main body. The communication opening is disposed between the image forming unit and the fixing unit in a plan view. The first feed path forming member has a first through hole formed vertically therethrough. The first through hole is open toward the communication opening and the communication opening is open toward the first through hole.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A general structure of an image forming apparatus, e.g., a printer 1, will be described.

Figure 1:
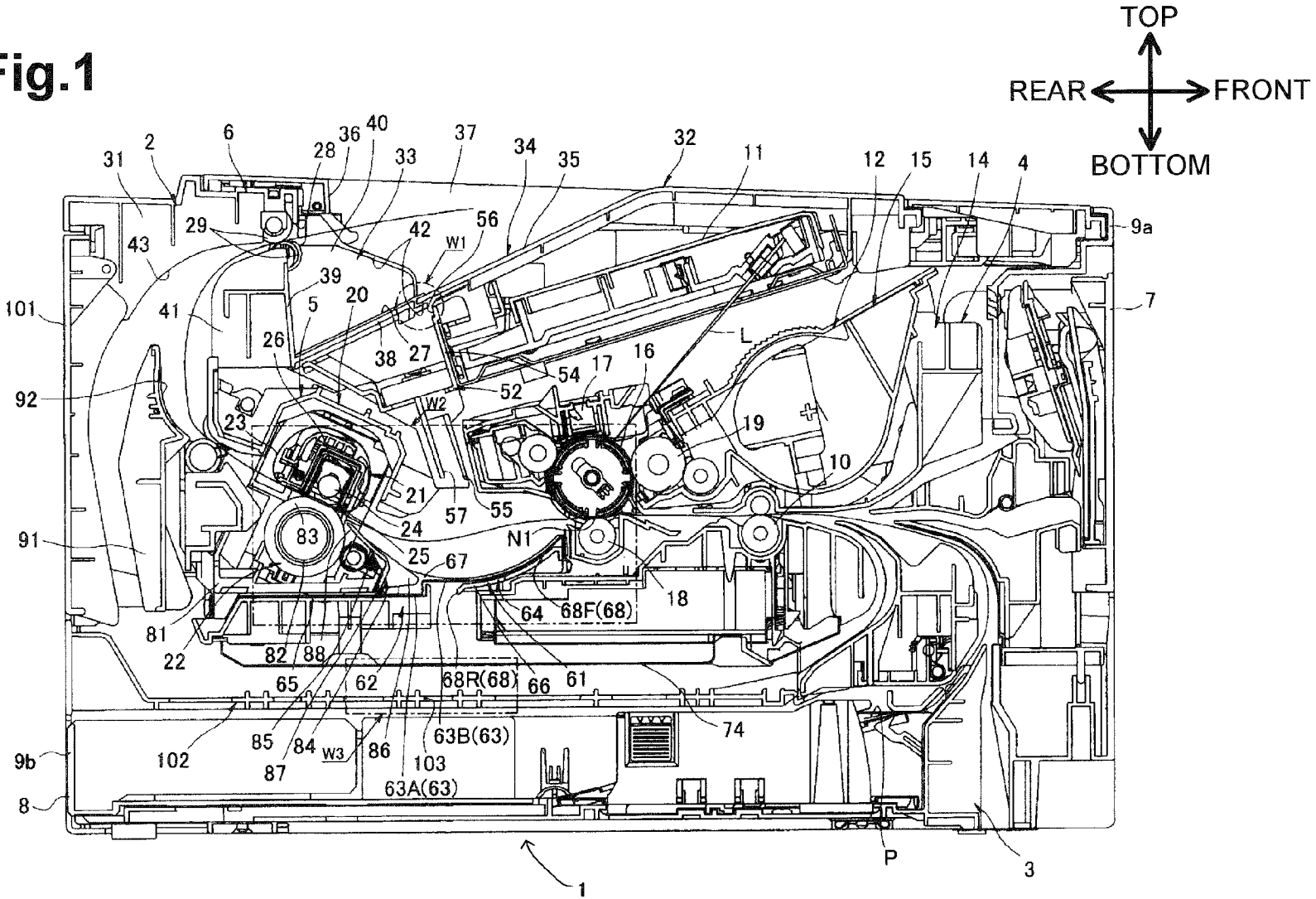
FIG. 1 is a sectional view schematically illustrating a printer as an example of an image forming apparatus according to an illustrative embodiment.

As shown in FIG. 1, the printer 1 may include, in a main body, e.g., a main body casing 2, a sheet supply unit 3, an image forming unit 4, a fixing section 5, and an ejection portion 6.

A sidewall 9*a*, which is disposed on a first end side of the main body casing 2 in the horizontal direction, contains a front cover 7 through which a process cartridge 12 is detachably attached. A sidewall 9*b* is disposed on a second end side of the main body casing 2 in the horizontal direction, such that the sidewall 9*b* faces the sidewall 9*a* at a distance from the sidewall 9*a*.

In the following description, the first end side (the left side in FIG. 1), in the horizontal direction, where the front cover 7 is disposed, is referred to as the front or front side of the printer 1, and the second end side (the left side in FIG. 1) opposite to the one end side is referred to as the rear or rear side of the printer 1. The left or left side and the right or right side are referred when the printer 1 is viewed from the front side.

The sheet supply unit 3 includes a storing member, e.g., a sheet supply tray 8, configured to store a stack of transferring members, e.g., recording sheets P, therein. The sheet supply tray 8 is disposed in a lower end portion of the main body casing 2 and configured to be detachably attachable from the front side.

The sheets P stored in the sheet supply tray 8 are singly fed by rotation of a sheet supply roller (not shown) disposed above the front end of the sheet supply tray 8, such that each sheet P is turned upward toward a registration roller 10 disposed in front of a photosensitive drum 16 via a sheet supply-side U-shaped path. By rotation of the registration roller 10, each sheet P is fed toward the image forming unit 4 (a contact portion N1 where the photosensitive drum 16 and a transfer roller 18 contact) at a specified timing.

Specifically, a leading end (or an end on a downstream side in a sheet feed direction) of a turned sheet P is fed from the front side (the first end side in the horizontal direction) toward the rear side (the second end side in the horizontal direction).

The image forming unit 4 includes a scanner unit 11 and the process cartridge 12.

The scanner unit 11 is disposed in an upper end portion of the main body casing 2. The scanner unit 11 is configured to emit a laser beam L toward the photosensitive drum 16 of the process cartridge based on image data and scan the surface of the photosensitive drum 16 by moving the laser beam L in one direction in a left and right direction at high speed.

The process cartridge 12 is disposed below the scanner unit 11. The process cartridge 12 includes a drum cartridge 14 and a developer cartridge 15 detachably attached to the drum cartridge 14.

The drum cartridge 14 rotatably accommodates the photosensitive drum 16 extending in the left-right direction and having substantially a cylindrical shape. The photosensitive drum 16 is configured to rotate upon receipt of a drive force from a motor 13 (FIG. 8) disposed inside the main body casing 2.

The drum cartridge 14 further accommodates a scorotron charger 17 and the transfer roller 18 which are arranged around the photosensitive drum 16.

The developer cartridge 15 is disposed in front of the photosensitive drum 16 and includes a developing roller 19.

The developing roller 19 is rotatably supported at a rear end portion of the developer cartridge 15 such that it is exposed from the rear side. The developing roller 19 is disposed to contact the photosensitive drum 16 such that the developing roller 19 presses the photosensitive drum 16 from the front side.

The developer cartridge 15 contains non-magnetic single-component toner which is to be positively charged, in a space in front of the developing roller 19.

The toner in the developer cartridge 15 is positively charged by rotation of the developing roller 19 and carried on a surface of the developing roller 19.

The surface of the photosensitive drum 16 is uniformly and positively charged by the scorotron charger 17 along with rotation of the photosensitive drum 16, and then exposed to the laser beam L from the scanner unit 11 by high-speed scanning. Thus, an electrostatic latent image corresponding to an image to be formed on a sheet P is formed on the surface of the photosensitive drum 16.

When the photosensitive drum 16 further rotates, toner carried on the surface of the developing roller 19 is supplied to the electrostatic latent image formed on the surface of the photosensitive drum 16. Thus, the electrostatic latent image on the photosensitive drum 16 is visualized into a toner image by a reversal development.

The toner image is transferred onto the sheet P fed to the contact portion N1 between the photosensitive drum 16 and the transfer roller 18.

The fixing section 5 is disposed at a distance from a rear side (the second end side in the horizontal direction) of the process cartridge 12, and includes a fixing unit 20.

The fixing unit 20 includes a heating unit 21 and a fixing roller 22.

The fixing unit 21 includes a heated film 23, a heating member 24, a nip plate 25, and a reflection plate 26.

The heated film 23 is heat-resistant and flexible, and is shaped in substantially a cylinder extending in the left-right direction. The heated film 23 is rotatably supported in the fixing unit 20, such that the heated film 23 circularly moved along with rotation of the fixing roller 22.

The heating element 24 includes a halogen lamp, and is shaped in a shaft extending in the left-right direction inside the heated film 23.

The nip plate 25 is shaped in substantially a flat plate extending in the left-right direction, and disposed between the heating element 24 and the heated film 23 such that the nip plate 25 contacts an inner surface of the heated film 23.

The reflection plate 26 extends in the left-right direction, and has substantially a U-shape whose lower ends are open. The lower ends of the reflection plate 26 engage the nip plate 25 from above such that the reflection plate 26 and the nip plate 25 enclose the heating element 24.

The nip plate 25, the reflection plate 26, and the heating element 24 are integrally pressed toward the fixing roller 22 by an urging member (not shown).

The fixing roller 22 includes a hollow rotational shaft 82 and a sponge roller 83 covering the rotational shaft 82 around. The fixing roller 22 is configured to rotate upon receipt of a drive force from the motor 13 (FIG. 8), which also transmits the drive force to the photosensitive drum 16.

The toner image transferred onto the sheet P is fixed by heat while the sheet P passes between the heated film 23 and the fixing roller 22 and undergoes heating and pressure.

The ejection portion 6 includes a tray member, e.g., an output tray 27.

The output tray 27 is recessed downward from the upper surface of the main body casing 2 and has substantially a V-shape in cross section whose upper side is open. The ejection portion 6 has an ejection opening 28 from which a sheet P is to be ejected.

The ejection opening 28 is shaped in a rectangle (FIG. 2), when viewed from the front, extends in the left-right direction and passes through a rear wall of the output tray 27 in the front-rear direction. In the ejection opening 28, a pair of ejection rollers 29 are disposed to feed the sheet P to the output tray 27. The ejection rollers 29 are configured to rotate reversibly. Specifically, one of the ejection rollers 29 is a drive roller and the other one is a driven roller. The ejection rollers 29 are configured to feed the sheet P to the output tray 27 when the drive roller of the ejection rollers 29 rotates in the normal direction, and to feed the sheet P to a second sheet feed path in the main body casing 2 when the drive roller rotates in the reverse rotation.

The sheet P having the toner image fixed thereon is fed toward between the ejection rollers 29, and ejected via the ejection opening 28 to the output tray 27 by normal rotation of the ejection rollers 29.

Figure 2:
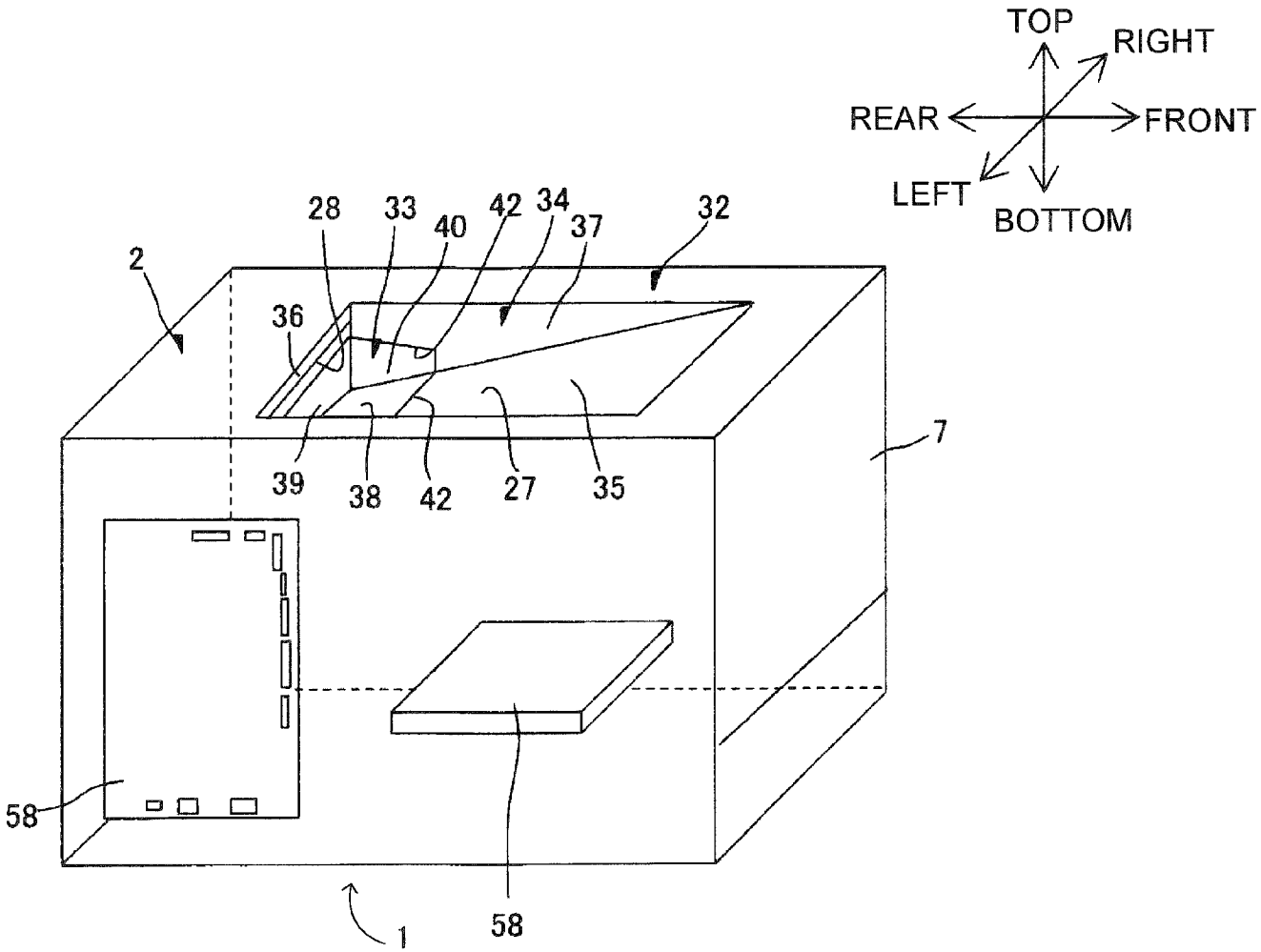
FIG. 2 is a perspective view, looking from upper left, of a main body casing of the printer shown in FIG. 1 in which power circuit boards are disposed.

As shown in FIGS. 1 and 2, the output tray 27 is located in a center of the top wall of the main body casing 2 in the left-right direction, and shaped in substantially a rectangle elongated in the front-rear direction as viewed from the top. Left and right ends of the output tray 27 are spaced a distance from left and right ends of the main body casing 2.

A bottom wall of the output tray 27 is disposed such that the rear side is at a level lower than the ejection opening 28 and is inclined upward from the rear side (the second end side in the horizontal direction) toward the front side (the first end side in the horizontal direction). A front end portion of the bottom wall of the output tray 27 extends such that the front end portion is at a level higher than the ejection opening 28

The top wall of the main body casing 2 contains a rear top cover 31, a top cover 32, and a tray forming member 33.

The rear top cover 31 extends in the left-right direction on a rear end portion of the upper surface of the main body casing 2, has substantially an L-shaped cross section, and rotatably supports the upper ejection roller 29.

The top cover 32 is located in front of the rear top cover 31 and shaped in substantially a flat plate covering an upper end portion of the main body casing 2. The top cover 32 includes a tray portion 34 constituting the output tray 27 in substantially a center both in the left-right direction and the front-rear direction.

The tray portion 34 constitutes a front half of the output tray 27, and is recessed downward continuously from the upper surface of the top cover 32 when viewed from the cross section, and shaped in substantially a rectangle when viewed from the top. An opening area of the tray portion 34 is greater in an upper side than in a lower side.

Specifically, the tray portion 34 includes a front wall 35, a rear wall 36, and a pair of left and right sidewalls 37. The front wall 35 extends as slanted downward toward the rear side. The rear wall 36 is spaced behind the front wall 35 and extends vertically. The sidewalls 37 extend vertically from left and right ends of the front wall 35. The sidewalls 37 further extend so as to connect to the rear wall 36.

A rear end portion of the front wall 35 of the tray portion 34 is disposed between the process cartridge 12 and the fixing unit 20 in a plan view. The rear wall 36 of the tray portion 34 is disposed above the fixing unit 20 in a plan view.

The tray forming member 33 is disposed between the rear end portion of the front wall 35 and the lower end portion of the rear wall 36, has a length in the left-right direction substantially equal to that of the tray portion 34, and has a V-like cross section, which is open upward. Specifically, the tray forming member 33 includes a front wall 38, a rear wall 39, and a pair of left and right sidewalls 40. The front wall 38 extends as slanted downward toward the rear side. The rear wall 39 extends vertically from the rear end of the front wall 38. The sidewalls 40 close the left and right sides of the tray forming member 33.

Figure 4:
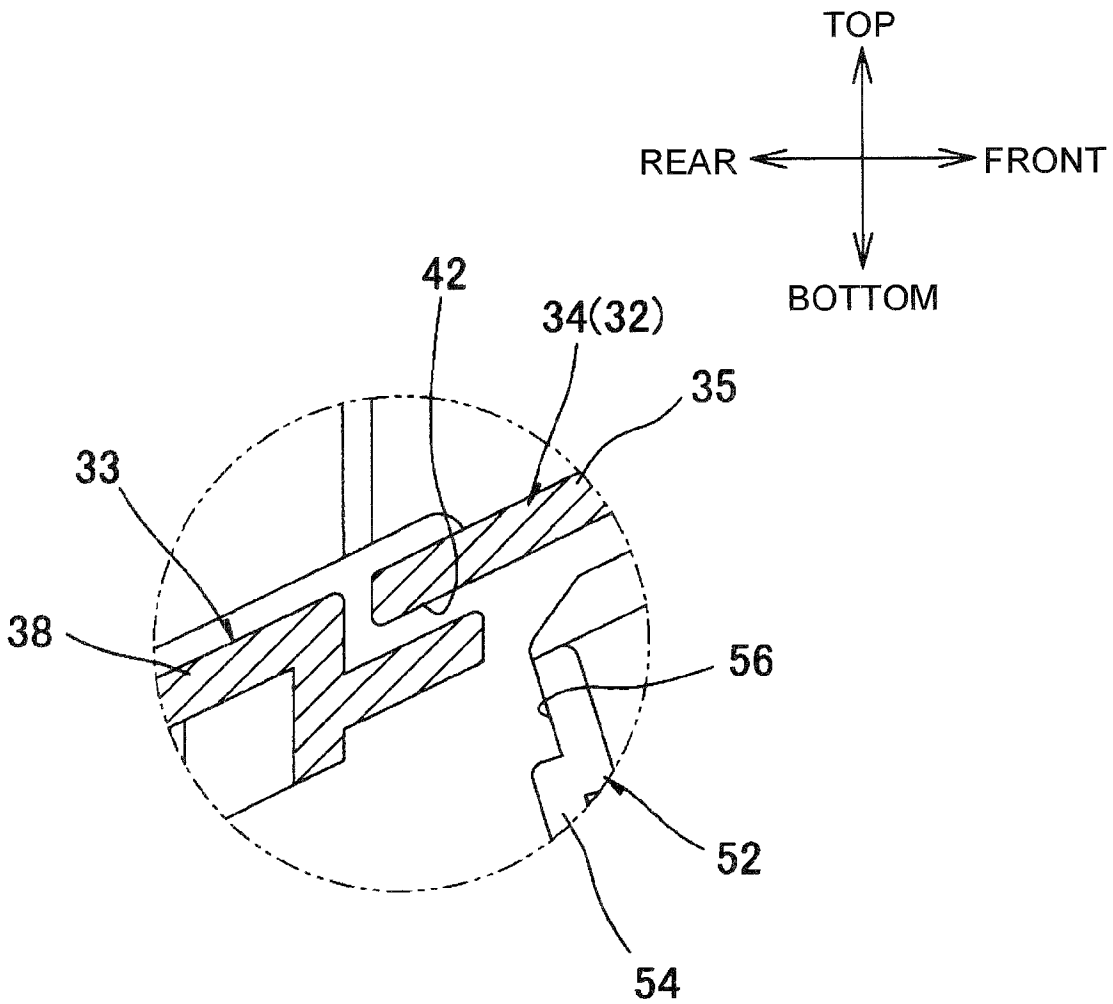
FIG. 4 is an enlarged view of a W1 portion of the printer shown in FIG. 1.

A front end of the front wall 38 of the tray forming member 33 is recessed downward from its upper end to have substantially an L-like shape, as viewed from a side, such that it can receive a rear end of the front wall 35 of the tray portion 34 from above (FIG. 4). An upper end of the rear wall 39 of the tray forming member 33 is disposed higher than the front end of the front wall 38 of the tray forming member 33.

The tray forming member 33 rotatably supports the lower ejection roller 29 at the upper end of the rear wall 39. The rear wall 39 of the tray forming member 33 includes a plurality of ribs 41 protruding rearward and extending vertically. The ribs 41 are arranged in the left-right direction.

Each of the ribs 41 is shaped such that its upper end is curved frontward as it goes upward.

The front end of the tray forming member 33 is coupled to the rear end of the front wall 35 of the tray portion 34 such that the lower ejection roller 29 faces the upper ejection roller 29 from below.

With this arrangement, the tray portion 34 of the top cover 32 and the tray forming member 33 make up of the ejection tray 27. The rear wall 39 of the tray forming member 33 and the rear wall 36 of the tray portion 34 are spaced apart from each other such that they are displaced in the front-rear direction and vertically.

Each rib 41 of the tray forming member 33 faces, from below, the front end of the rear top cover 31 at a vertical distance away, and each rib 41 and the rear top cover 31 form an ejection path 43 curved frontward as it goes upward.

An upper surface of the front wall 38 of the tray forming member 33 is flush with an upper surface of the front wall 35 of the tray portion 34 such that a communication opening, e.g., a gap 42, is formed between the tray forming member 33 and the tray portion 34.

The gap 42 is formed between the front wall 38 of the tray forming member 33 and the front wall 35 of the tray portion 34. In other words, the gap 42 is formed across the entire width of the ejection tray 27 in the left-right direction.

As shown in FIG. 4, the gap 42 has substantially an L-like cross section where the gap 42 extends vertically between the front wall 38 of the tray forming member 33 and the front wall 35 of the tray portion 34 and is bent frontward at a bottom portion of the gap 42. The gap 42 is open upward between the front wall 38 of the tray forming member 33 and the front wall 35 of the tray portion 34. When projected in the front-rear direction, the gap 42 is located below the ejection opening 28 (refer to FIG. 1).

Figure 3:
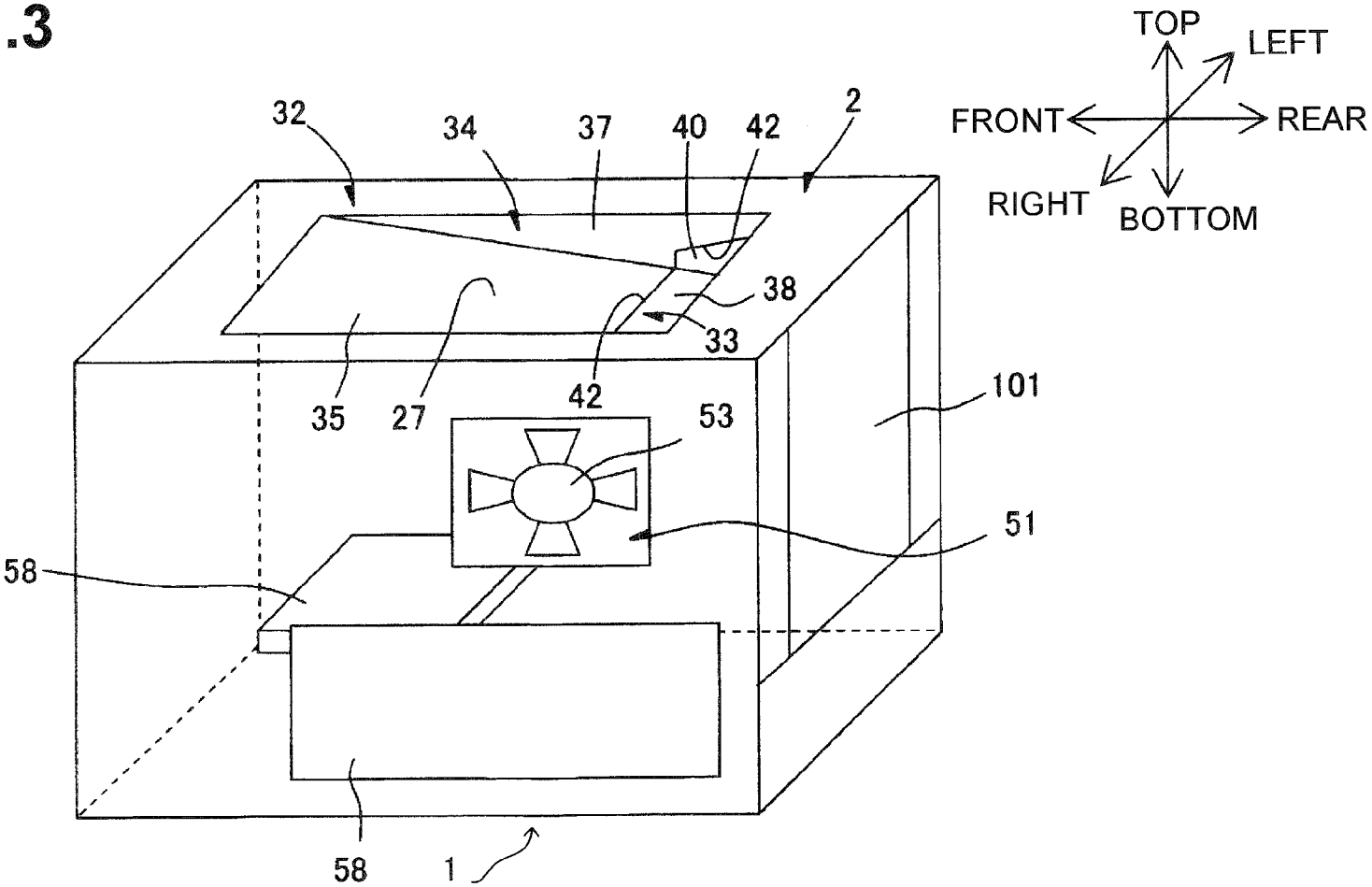
FIG. 3 is a perspective view, looking from upper right, of the main body casing of the printer shown in FIG. 1 in which the power circuit boards are disposed.

As shown in FIGS. 1 and 3, the main body casing 2 includes an exhaust unit 51 (FIG. 3) configured to exhaust air from the main body casing 2, and a communication member, e.g., a duct member 52 (FIG. 1), configured to guide air in the main body casing 2 to the exhaust unit 51.

The exhaust unit 51 includes a fan 53 rotatably, and is fixed to a right sidewall of the main body casing 2 such that the exhaust unit 51 is disposed between the photosensitive drum 16 and the fixing unit 20 when projected in the left-right direction. The exhaust unit 51 is configured to exhaust air from the main body casing 2 via an exhaust hole (not shown) formed through the right sidewall of the main body casing 2.

The duct member 52 is disposed on a left side of the exhaust unit 51 and has substantially a tubular shape extending in the left-right direction. Specifically, the duct member 52 includes a duct body 54 disposed facing the left side of the exhaust unit 51, and a duct partition plate 55 extending downward from the duct body 54 and being disposed between the process cartridge 12 and the fixing unit 20.

The duct body 54 extends in the left-right direction, and has substantially an angular cylindrical shape (specifically, a trapezoid having an upper base longer than a lower base as viewed in cross section). An upper end portion of the duct body 54 is open. An upper end of a front wall of the duct body 54 is spaced a distance from the front side of the tray forming member 33. An upper end of a rear wall of the duct body 54 is disposed below the rear wall 39 of the tray forming member 33. In other words, the upper end portion of the duct body 54 defines a first opening 56, which is open toward the gap 42.

The duct partition plate 55 extends downward from the lower end of the duct body 54. The duct partition plate 55 has a length in the front-rear direction shorter than a length of the duct member 54 in the front-rear direction. In other words, a cross-sectional area of a second opening 57 is smaller than that of the first opening 56.

An upper end of the duct partition plate 55 is disposed in the duct body 54, and a lower end of the duct partition plate 55 is disposed between the process cartridge 12 and the fixing unit 20. In other words, the lower end of the duct partition plate 55 defines the second opening 57, which is open toward the first opening 56.

The lower end of the duct partition plate 55 is disposed above a second straight line L2 (which will be described later; refer to FIG. 8) so as not to interfere with a sheet P fed from the process cartridge 12 to the fixing unit 20.

As shown in FIGS. 2 and 3, power circuit boards 58 that control operations of the printer 1 are disposed in the main body casing 2.

Of the power circuit boards 58, one is disposed inside the left sidewall of the main body casing 2, another is disposed inside the right sidewall of the main body casing 2 (specifically these two are disposed between each of the left and right sidewalls of the main body casing 2 and the ejection tray 27 in a plan view), and the other one is disposed below the process cartridge 12.

As shown in FIG. 1, a first lower wall forming member 61 (FIG. 6) is disposed between the photosensitive drum 16 and the fixing unit 20 and above the sheet supply tray 8, and forms a lower wall of a first feed path (which will be described later)

Figure 5:
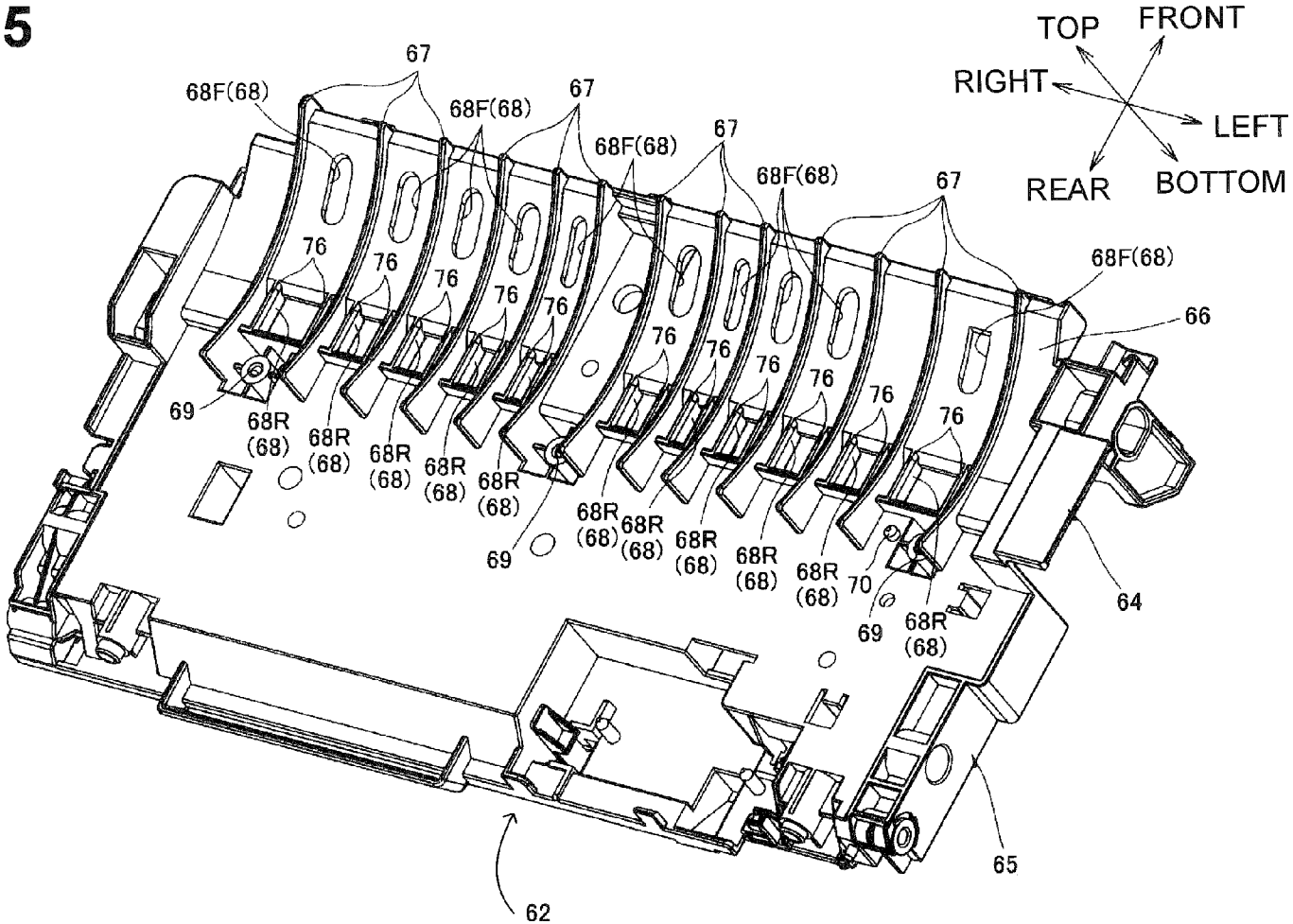
FIG. 5 is a perspective view, looking from rear left, of a first lower wall forming member shown in FIG. 1, from which a cover member is removed.
Figure 6:
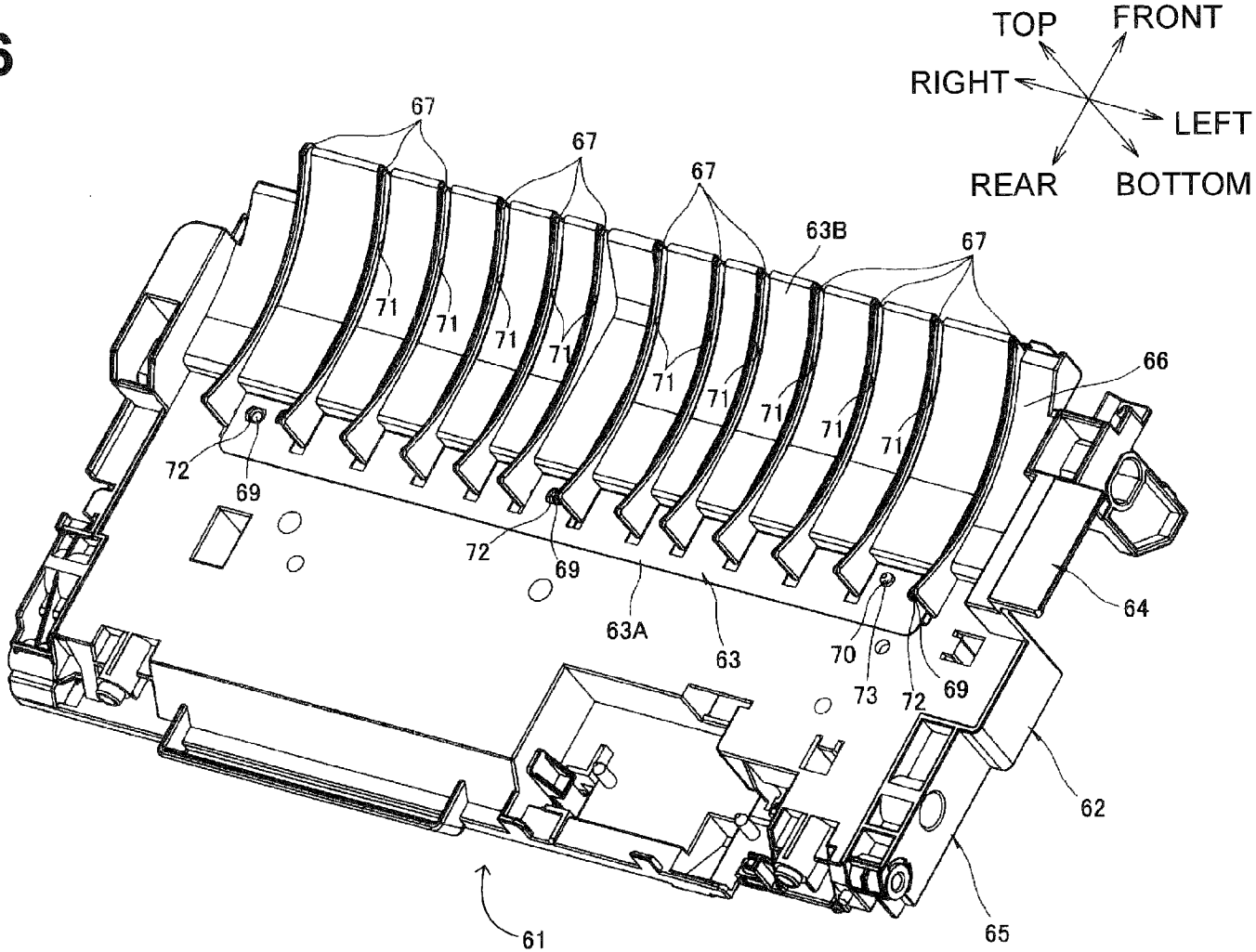
FIG. 6 is a perspective view, looking from rear left, of the first lower wall forming member shown in FIG. 1, from which the cover member is removed.

The first lower wall forming member 61 is formed by attaching a covering member 63 shown in FIG. 6 to a front end portion of a frame 62 shown in FIG. 5 from above, and has a shape of substantially a flat plate extending in the front-rear and left-right directions. The first lower wall forming member 61 is disposed such that a front end portion of the first lower wall forming member 61 faces the rear end portion of the photosensitive drum 16 from a distance and left and right end portion of the first lower wall forming member 61 are fixed to the left and right sidewalls (not shown) of the main body casing 2.

The frame 62 is made of resin, e.g., polystyrene, and the covering member 63 is made of metal.

The frame 62 has the form of substantially a flat plate extending in the front-rear and left-right directions, and integrally includes a fixing unit support portion 65 for supporting the fixing unit 20, and a first feed path forming member, e.g., a path forming portion 64.

The fixing unit support portion 65 is a rear half of the frame 62, having the form of substantially a flat plate having a specified thickness (a vertical length). The fixing unit support portion 65 and the fixing unit 20 are substantially equal in a front-rear length (FIG. 1).

The path forming portion 64 is a front half of the frame 62, and includes a curved plate 66 curved upward as it goes to the front and ribs 67 standing on an upper surface of the curved plate 66 and extending in the front-rear direction. The path forming portion 64 has through holes 68 formed vertically therethrough.

The curved plate 66 extends upward from a front end portion of the fixing unit support portion 65 and is curved upward with a specified radius of curvature as it goes to the front side. In other words, the curved plate 66 is curved such that it is recessed downward. A rear end portion of the curved plate 66 is disposed lowest and a front end portion thereof is disposed highest.

The ribs 67 protrude upward from an upper surface of the curved plate 66 and an upper surface in a front end portion of the fixing unit support portion 65. The ribs 67 are arranged and spaced apart from each other in the left-right direction. Upper edges of the ribs 67 are curved with the same radius of curvature as the curved plate 66. Rear end portions of the ribs 67 are disposed at the rear of the rear end portion of the curved plate 66, and upper edges in the rear end portions of the ribs 67 are curved upward as they go to the rear side.

The through holes 68 are aligned in a front-side row and a rear-side row on the curved plate 66 and spaced apart from each other in the left-right direction. In the following description, the through holes 68 in the front-side row are referred to as front-side through holes 68F and the through holes 68 in the rear-side row are referred to as rear-side through holes 68R, as an example of a first through hole.

Each of the front-side through holes 68F is located between adjacent ribs 67 in the front end portion of the curved plate 66 and is formed as a long hole extending in the front-rear direction.

Each of the rear-side through holes 68R is located between adjacent ribs 67 in the rear end portion of the curved plate 66 such that it is open toward the second opening 57 of the duct member 52 from below, and is shaped in substantially a rectangle. Specifically, a space defined by the adjacent ribs 76 in the rear portion of the curved plate 66 is partitioned into three compartments by two partition plates 76 spaced in the left-right direction in the space. Each of the rear-side through holes 68R is formed vertically through between the two partition plates 76 or in a middle compartment of the three compartments. The curved plate 66 is closed between each rib 67 and each partition plate 76 or in left and right compartments of the three compartments.

The frame 62 has screw holes 69 formed each in left, center, and right positions in the front end portion of the fixing unit support portion 65. A positioning boss 70 having substantially a cylindrical shape protrudes upward in the vicinity of the left screw hole 69.

The covering member 63 is bent to fit the shape of the path forming portion 64 of the frame 62. Specifically, the covering member 63 integrally includes a fixing portion 63A, which is fixed to the front end portion of the fixing unit support portion 65, and a covering portion 63B, which covers the path forming member 64 of the frame 62.

The fixing portion 63A is shaped like substantially a rectangle, which is longer in the left-right direction, in the rear end portion of the covering member 63. The fixing portion 63A has screw insertion holes 72 formed each in left, center, and right positions to correspond the screw holes 69 of the frame 62. The fixing portion 63A further has a boss insertion hole 73 having the form of substantially a circle, which is formed therethrough in the vicinity of the left screw insertion hole 72 to correspond to the positioning boss 70 of the frame 62. The positioning boss 70 of the frame 62 is inserted into the boss insertion hole 73. With this insertion, the covering member 63 is positioned in the front-rear and left-right directions relative to the frame 62.

The covering portion 63B extends upward from the front end portion of the fixing portion 63A and is curved upward with the same radius of curvature as the curved plate 66 as it goes to the front side, such that the covering portion 63B is spaced apart upward from the curved plate 66. In other words, the covering portion 63B is curved such that it is recessed downward as well as the curved plate 66.

A front end portion of the covering portion 63B is bent downward to correspond to the front end portion of the path forming portion 64 and then extends vertically.

The covering member 63 further has slits 71 extending in the front-rear direction to correspond to the respective ribs 67.

The slits 71 are formed to have a width wider than the thickness of each rib 67 (in the left-right direction) and a length longer than the length of each rib 67 in the front-rear direction, and arranged and spaced apart from each other in the left-right direction.

The covering member 63 covers the curved plate 66 of the frame 62 such that the ribs 67 of the frame 62 are inserted into the respective slits 71 and protrude upward further than the covering member 63. At this time, the covering member 63 covers the curved plate 66 such that the slits do not overlap the through holes 68 in a plan view.

At this time, the positioning boss 70 of the frame 62 is inserted into the positioning boss insertion hole 73 of the covering member 63 and the screw insertion holes 72 of the covering member 63 are aligned with the respective screw holes 69 vertically.

The covering member 63 is fixed to the frame 62 by tightening screws (not shown) into the screw holes 69 via the screw insertion holes 72.

The covering member 63 is electrically connected to the main body casing 2 via wiring, and electrically grounded via the main body casing 2.

Under the first lower wall forming member 61, a reinforcing plate 74 is disposed such that it extends between the left and right sidewalls of the main body casing 2. The reinforcing plate 74 is made of metal and configured to support the first lower wall forming member 61 from below (FIG. 1).

The reinforcing plate 74 has through holes 75 formed vertically therethrough (FIG. 9) in positions aligned with the rear-side through holes 68R.

Figure 7:
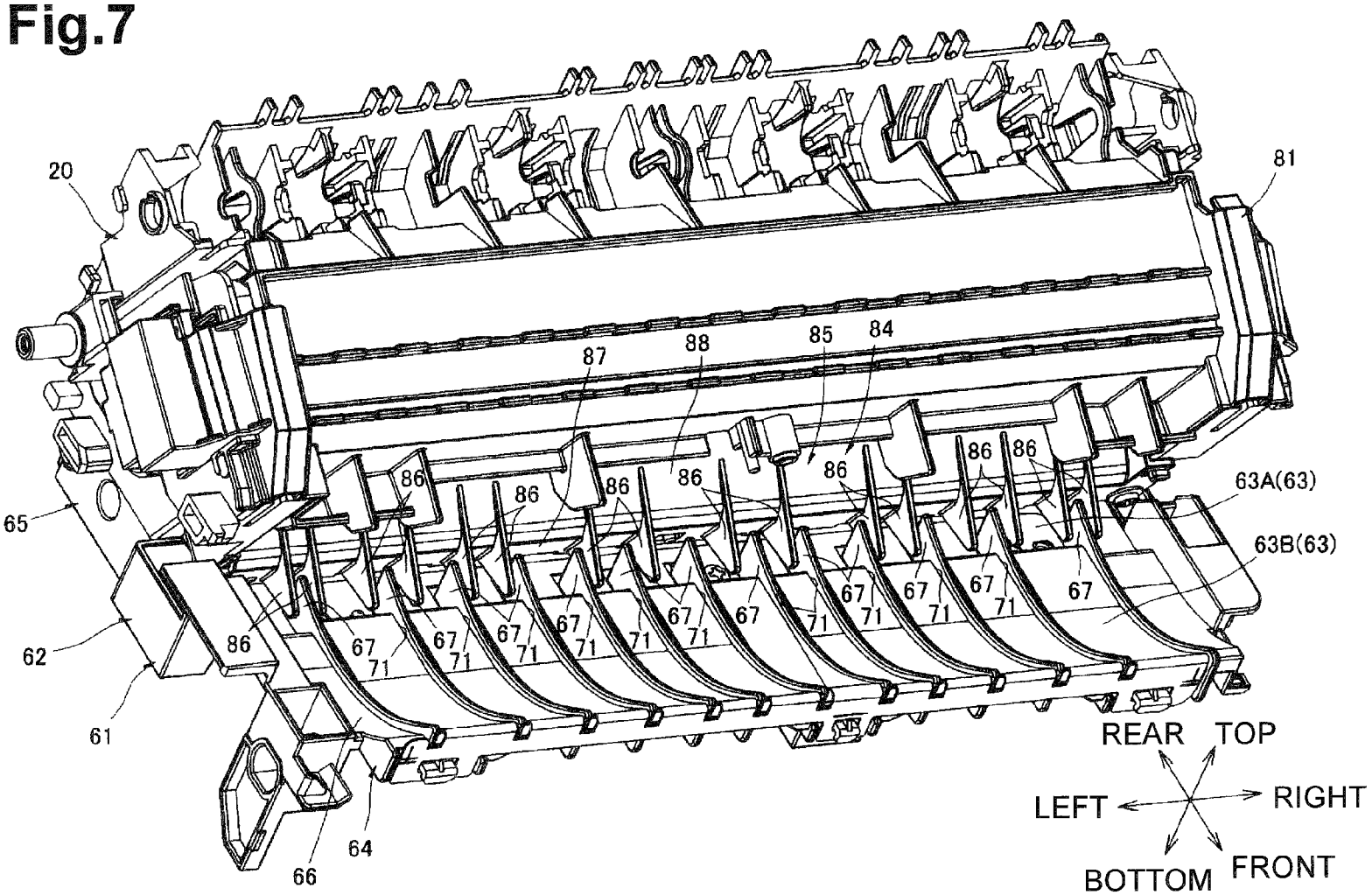
FIG. 7 is a perspective view, looking from front left, of a fixing unit and the first lower wall forming member shown in FIG. 1.
Figure 8:
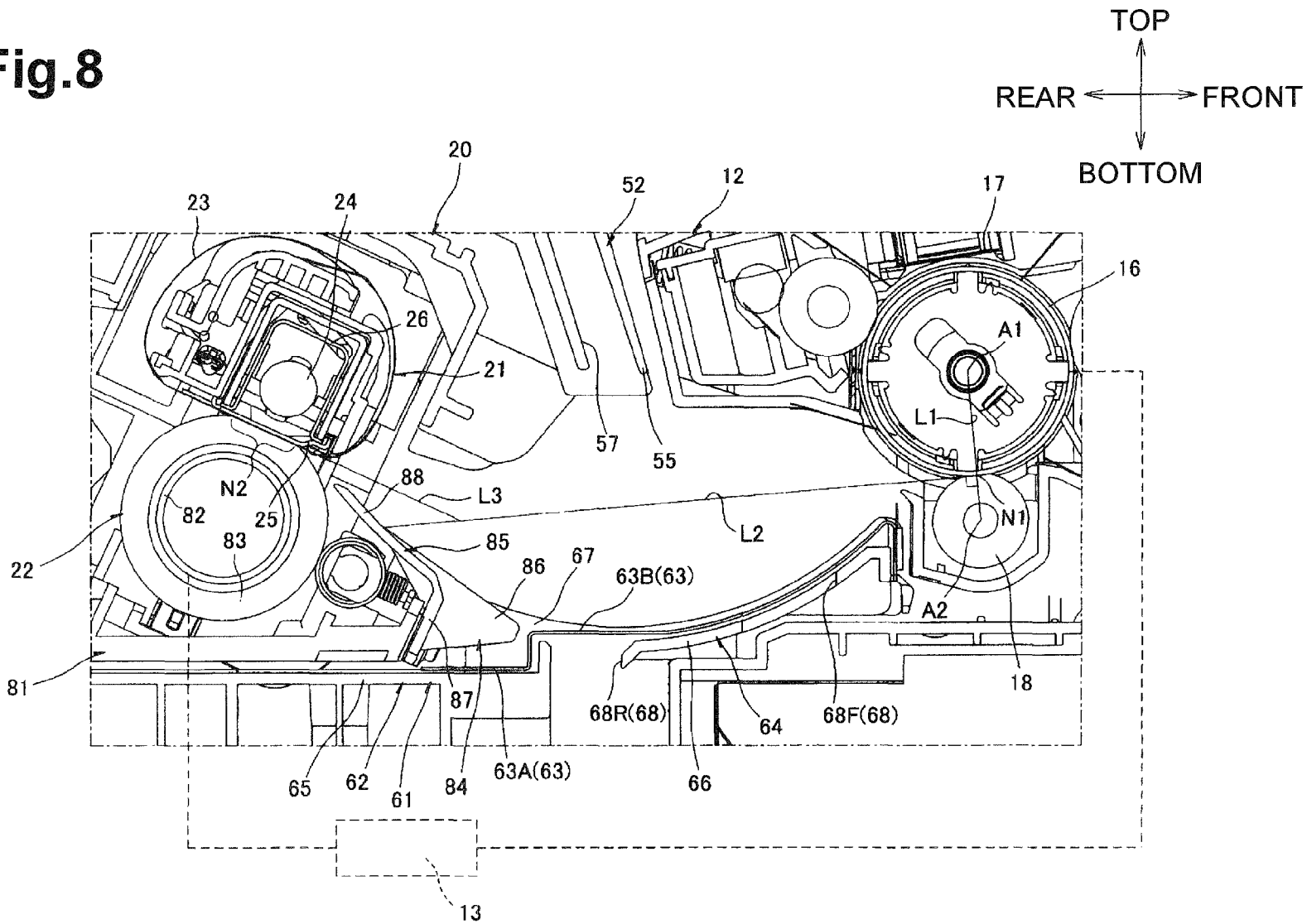
FIG. 8 is an enlarged view of a W2 portion of the printer shown in FIG. 1.

As shown in FIGS. 7 and 8, the fixing unit 20 is disposed at the rear of the path forming portion 64 of the first lower wall forming member 61 such that the fixing unit 20 is located above the fixing unit support portion 65 of the first lower wall forming member 61. Front and rear end portions of the fixing unit 20 are fixed to the fixing unit support portion 65 of the first lower wall forming member 61, and left and right end portions of the fixing unit 20 are positioned at the left and right sidewalls of the main body casing 2.

The fixing unit 20 includes a fixing frame 81 accommodates the heating unit 21 and the fixing roller 22.

The fixing frame 81 is shaped like substantially a box extending in the left-right direction. The fixing frame 81

The fixing frame 81 includes a guide 84 configured to guide a sheet P in front of a contact portion N2 where the fixing roller 22 and the heated film 23 contact.

The guide 84 is made of a resin, e.g., polyethylene terephthalate, which is heat-resistant and tends to be negatively charged relatively on the triboelectric series. The guide 84 extends toward the front, and includes a covering plate 85 that covers a front lower end portion of the fixing frame 81 in front of the fixing roller 22, and a plurality of guide ribs 86 extending to a lower front side from the covering plate 85.

The covering plate 85 has substantially an L-like shape, as viewed in cross section, and includes a guide fixing portion 87 extending substantially vertically, and a guide portion 88 extending to an upper rear side from an upper end of the guide fixing portion 87.

The guide fixing portion 87 is screwed to a front lower end portion of the fixing frame 81 from the front side.

The guide portion 88 is curved upward as it goes to the rear side with a smaller radius of curvature than the upper edges of the ribs 67. The upper edges of the ribs 67 are curved with a greater radius of curvature than an upper surface of the guide portion 88.

As projected in the left-right direction, the guide portion 88 crosses a straight line L2 passing the contact portion N1 between the photosensitive drum 16 and the transfer roller 18, on a first straight line L1 connecting an axis A1 of the photosensitive drum 16 and an axis of the transfer roller 18.

In the fixing unit 20, the heating unit 21 contacts the fixing roller 22 such that a contact portion N2 slants upward as it goes to the rear side.

In other words, a line L3 passing the contact portion N2 in the sheet feed direction (toward an upper rear side) and the straight line L2 cross each other to form a downward protrusion above the path forming portion 64 of the first lower wall forming member 61. Specifically, the second line L2 extends to a lower rear side, and the line L3 extends to a lower front side. A point of intersection of the straight lien L2 and the line L3 is located within a curved portion of the first lower wall forming member 61 (or inside a recess formed by the path forming portion 64 and the guide 84).

The guide ribs 86 protrude frontward from the front surface of the guide fixing portion 87 and the upper surface of the guide portion 88 facing to the front side, and are each shaped in substantially a triangle having an end portion pointed toward a lower front side as viewed from a side. The guide ribs 86 are spaced apart from each other in the left-right direction such that the guide ribs 86 are located between the ribs 67 of the first lower wall forming member 61. Upper edges of the guide ribs 86 are bent upward as they go rearward with a smaller radius of curvature than those of the ribs 67. In other words, the upper edges of the ribs 67 are bent with a greater radius of curvature than those of the upper edges of the guide ribs 86.

When projected in the left-right direction, a front end portion of each guide rib 86 overlaps a rear end portion of each rib 67 of the first lower wall forming member 61, and is located below the upper edge of each rib 67 of the first lower wall forming member 61.

As shown in FIG. 1, the main body casing 2 includes inside an ejection guide 91, which is disposed at the rear of the fixing unit 20 and configured to turn a sheet P passing the contact portion N2 in the fixing unit 20 upward.

The ejection guide 91 has the form of substantially a flat plate having a thickness in the front-rear direction and extending vertically. The ejection guide 91 includes a curved surface 92 disposed at an upper end portion thereof and curved upward as it goes to the rear side.

As described above, a sheet P is singly fed from the sheet supply tray 8 toward the registration roller 10, and then toward the contact portion N1 between the photosensitive drum 16 and the transfer roller 18, at a specified time. After passing the contact portion N1, the sheet P is fed to the fixing unit 20, passing between the heated film 23 and the fixing roller 22, turned upward by the ejection guide 91 and ejected to the output tray 27 via the ejection opening 28 (the first feed path).

Specifically, after passing through the contact portion N1 between the photosensitive drum 16 and the transfer roller 18, the sheet P is fed rearward or toward the fixing unit 20 nearly along the second straight line L2 by rotation of the photo sensitive drum 16.

A trailing end of the sheet P (an end on a downstream side in the sheet feed direction) contacts the guide portion 88 or the guide ribs 86, is guided to an upper rear side by the guide portion 88, and goes between the heated film 23 and the fixing roller 22.

Then, the sheet P is fed toward an upper rear side nearly along the line L3 by rotation of the fixing roller 22.

A speed of the photosensitive drum 16 to feed a sheet P is set slightly faster than a speed of the fixing roller 22 to feed a sheet P. The sheet P is fed from between the photosensitive drum 16 and the transfer roller 18 toward the fixing unit 20 at a distance away from an upper side of the path forming member 64.

The sponge roller 83 of the fixing roller 22 may expand by heat applied by the heating unit 21. If the sponge roller 83 expands, a circumferential velocity of the sponge roller 83 may be lowered, having a potential that the sheet P may be deflected to a greater extent than would be expected.

Even in this case, however, the sheet P is fed such that it is deflected downward to an extent that the path forming member 64 is bent to have a downward recess.

As shown in FIG. 1, a rear cover 101 is disposed at the rear end portion of the main body casing 2 and spaced apart from the ejection guide 91 at the rear thereof.

The rear cover 101 has the form of substantially a flat plate extending vertically such that it continues to a bottom portion of the rear end of the rear top cover 31. A front surface of the rear cover 101 continues to a rear side of a lower surface of the rear cover 31 and is curved downward as it goes to the rear side.

Figure 9:
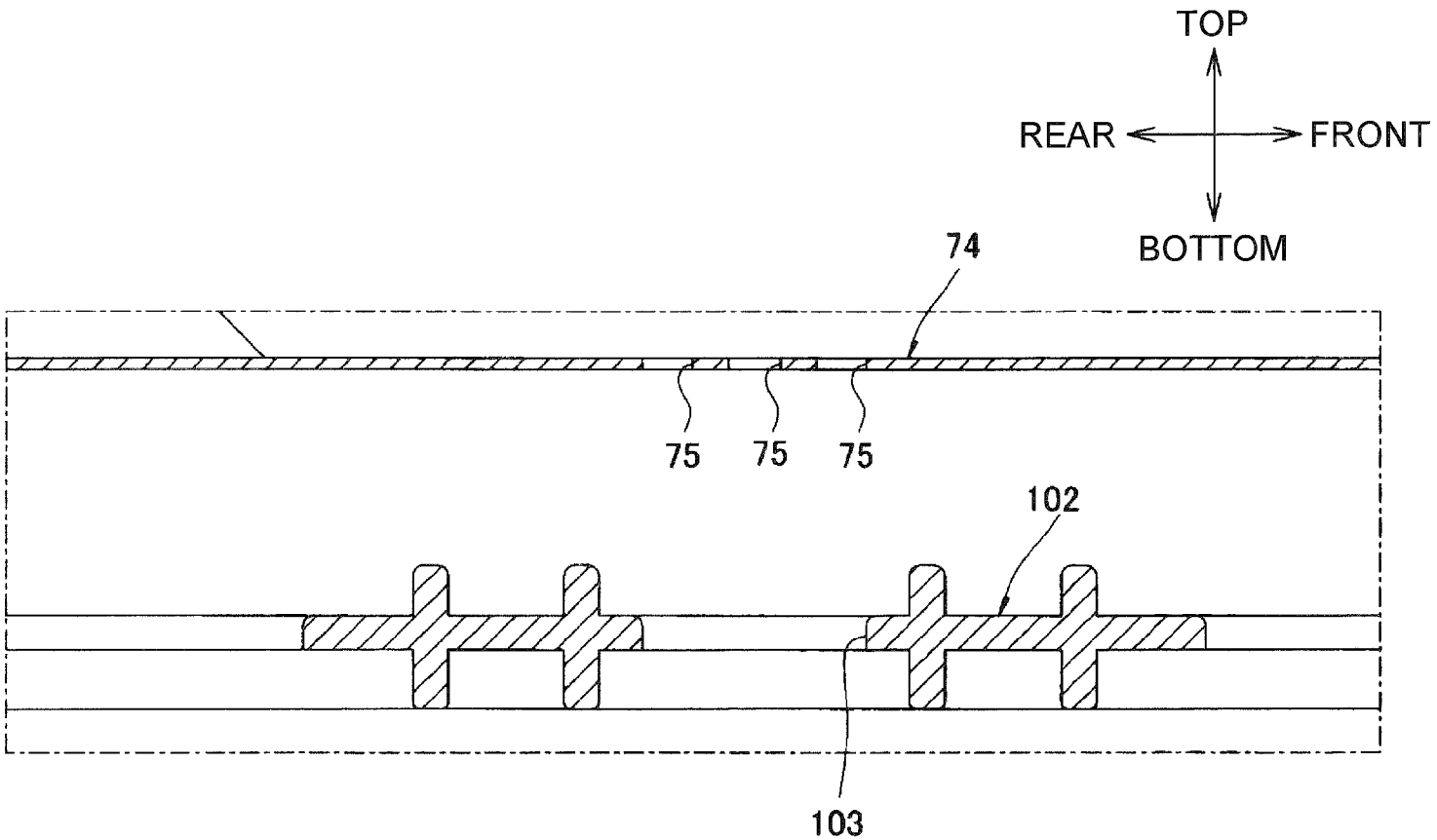
FIG. 9 is an enlarged view of a W3 portion of the printer shown in FIG. 1.

As shown in FIGS. 1 and 9, a second lower wall forming member 102, as an example of a second feed path forming member that forms a second feed path (which will be described later), is disposed above the sheet supply tray 8. The second lower wall forming member 102 is spaced apart from and facing the reinforcing plate 74 from below.

The second lower wall forming member 102 is shaped in substantially a flat plate extending in the front-rear direction. A front end portion of the second lower wall forming member 102 is located nearly under the registration roller 10, and a rear end portion of the second lower wall forming member 102 is located under the rear cover 101.

The second lower wall forming member 102 has a through hole 103, which is formed vertically therethrough and open toward the rear-side through holes 68R of the first lower wall forming member 61.

On a front side of the second lower wall forming member 102, a re-feed-side U-shaped path where a sheet P is turned upward from the front side of the second lower wall forming member 102 toward the registration roller 10 is formed at the rear of the sheet supply-side U-shaped path.

A sheet P having an image printed on one side along the first feed path is fed via the ejection opening 28 to the output tray 27 when the drive roller of the ejection rollers 29 rotates in the normal direction.

When an image is printed on the other side of the sheet P (during duplex printing), the sheet P is fed toward the output tray 27 until a collision between an upstream-side end (or a trailing end) of the sheet P in the sheet feed direction and the curved surface 92 of the ejection guide 91 is cleared, and then the ejection rollers 29 are reversely rotated before the sheet P is ejected onto the output tray 27.

Then, the sheet P is guided by a lower surface of the rear top cover 31 and the front surface of the rear cover 101 and fed between the rear cover 101 and the ejection guide 91 from the trailing end.

In other words, when the sheet P is fed along the second feed path, the upstream-side end of the sheet P along the first feed path is a downstream-side end.

The sheet P is fed downward such that it passes between the rear cover 101 and the ejection guide 91 (or the sheet P is turned downward), and then fed from the rear side (the second end side in the horizontal direction) to the front side (the first end side in the horizontal direction) such that it passes between the second lower wall forming member 102 and the reinforcing plate 74.

The sheet P fed to the front end portion of the second lower wall forming member 102 is turned upward and fed along the first feed path again from the front side of the registration roller 10.

When a liquid is spilled on the output tray 27 of the main body casing 2, the liquid enters the main body casing 2 through the gap 42 of the output tray 27. Then, the liquid passes through the duct member 52 from the first opening 56 of the duct member 54, and flows down to the path forming portion 64 of the first lower wall forming member 61.

Then, the liquid that has flown down to the path forming portion 64 of the first lower wall forming member 61 passes through the through holes 75 of the reinforcing plate 74 and the through holes 103 of the second lower wall forming member 102 in order, and stands in the sheet supply tray 8.

According to the printer 1, as shown in FIG. 1, the output tray 27, which is provided at the upper end portion of the main body casing 2, has the gap 42 such that the gap 42 is provided between the image forming unit 4 and the fixing unit 20 in a plan view. The path forming portion 64 of the first lower wall forming member 61 that forms the first feed path along which the sheet P is fed has the rear-side through holes 68R, which are formed through vertically and are open toward the gap 42.

Thus, when the liquid is spilled on the upper portion of the main body casing 2, the liquid is caused to pass between the image forming unit 4 and the fixing unit 20 via the gap 42 of the output tray 27, and then to flow further downward via the rear-side through holes 68R of the path forming portion 64.

In other words, the liquid spilled on the upper portion of the main body casing 2 may be guided further downward than the image forming unit 4 and the fixing unit 20 so as to protect them from getting wet as much as possible.

As a result, in a case that a liquid is spilled on the upper portion of the main body casing 2, the image forming unit 4 and the fixing unit 20 may be protected from getting wet.

According to the printer 1, as shown in FIG. 8, the path forming portion 64 is curved such that it is recessed downward, and the rear-side through hole 68R is formed at the lowermost part of the path forming portion 64.

Thus, the liquid flowing down after passing between the image forming unit 4 and the fixing unit 20 via the gap 42 of the output tray 27 is collected into the rear-side through hole 68R through the curve of the path forming portion 64.

As a result, the liquid entering the main body casing 2 can be effectively guided further downward than the image forming unit 4 and the fixing unit 20.

According to the printer 1, as shown in FIG. 1, the duct member 52 is disposed between the gap 42 and the rear-side through holes 68R, and has the first opening 56 that is open toward the gap 42 from below and the second opening 57 that is open toward the rear-side through holes 68R from above.

Thus, the liquid entering the main body casing 2 via the gap 42 of the output tray 27 can be guided to the rear-side through holes 68R by the duct member 52, and reliably caused to pass between the image forming unit 4 and the fixing unit 20.

As a result, the image forming unit 4 and the fixing unit 20 can be protected from getting wet.

According to the printer 1, a shown in FIG. 1, the duct member 52 is shaped such that the cross-sectional area of the second opening 57 is smaller than that of the first opening 56.

Thus, the liquid entering the main body casing 2 via the gap 42 of the output tray 27 can be reliably received in the first opening 56 having a relatively greater cross-sectional area and reliably guided to the rear-side through holes 68R through the second opening 57 having a relatively smaller cross-sectional area.

As a result, the liquid entering the main body casing 2 via the gap 42 of the output tray 27 can be reliably caused to pass between the image forming unit 4 and the fixing unit 20 and the image forming unit 4 and the fixing unit 20 can be protected from getting wet.

According to the printer 1, as shown in FIG. 1, the liquid entering the main body casing 2 via the gap 42 of the output tray 27 can be guided through the use of the duct member 52 that is configured to discharge air out of the main body casing 2.

Thus, without increasing the number of parts, the liquid entering the main body casing 2 can be guided.

According to the printer 1, as shown in FIG. 1, the gap 42 is disposed below the ejection opening 28 when projected in the front-rear direction.

Thus, even in a case that a large amount of liquid flows in the output tray 27 and the liquid stands above the output tray 27, the liquid can flow toward the gap 42 more preferentially than the ejection opening 28.

Thus, the liquid can be prevented from flowing to the ejection opening 28.

According to the printer 1, as shown in FIG. 1, the second lower wall forming member 102, which forms the second feed path, has the through hole 103 which is formed vertically therethrough and is open toward the rear-side through holes 68R.

Thus, when the second feed path is formed under the image forming unit 4, the first lower wall forming member 61 and the fixing unit 20, the liquid entering the main body casing 2 can be guided to a location below the second feed path via the through hole 103.

According to the printer 1, as shown in FIG. 1, the sheet supply tray 8 for accommodating a stack of sheets is disposed in the lower portion of the main body casing 2.

Thus, the liquid entering the main body casing 2 can be guided to a location below the image forming unit 4 and the fixing unit 20 and then received at the sheet supply tray 8.

The above illustrative embodiment shows, but is not limited to, the path forming portion 64 and the covering member 63 which are curved such that they are recessed downward. The path forming portion 64 and the covering member 63 may be formed flat, for example.

The above illustrative embodiment shows, but is not limited to, the rear-side through holes 68R and the second opening 57 that are open toward each other. The rear-side through holes 68R and the second opening 57 may be slightly displaced from each other.

The above illustrative embodiment shows, but is not limited to, the sheet supply tray 8 disposed in the lower portion of the main body casing 2. A stack of sheets P may be accommodated in a tray extending out of the main body casing 2.

The above illustrative embodiment shows, but is not limited to, the sheets P as a transferring member. The transferring member may include a transparency.

The above illustrative embodiment shows, but is not limited to, the printer 1 as an example of an image forming apparatus. The disclosure may be applied to other types of image forming apparatuses, e.g., a monochrome printer, a copier, and a multifunction apparatus.

Even with modifications described above, it is clear that effects similar to those brought about by the embodiment can be appreciated.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus comprising:

a main body including a first end side and a second end side;

an image forming unit disposed in the main body, the image forming unit being configured to form an image on a transferring member, the image forming unit including a photosensitive member, wherein the image forming unit is disposed between the first end side and the second end side;

a fixing unit disposed in the main body, the fixing unit being configured to fix the image onto the transferring member, wherein the fixing unit is disposed between the first end side and the second end side;

a first feed path forming member disposed in the main body between the image forming unit and the fixing unit in a first direction, wherein the first direction extends from the first end side to the second end side, the first feed path forming member forming a first feed path along which the transferring member is fed; and an ejection portion configured to eject the transferring member on which the image is fixed at the fixing unit out of the main body, the ejection portion including a tray member, the tray member being disposed at an upper end portion of the main body and configured to receive the transferring member ejected therein, the tray member having a wall configured to support the transferring member ejected therein and a communication opening formed in the wall and providing communication between an inside and an outside of the main body, the communication opening being disposed between the image forming unit and the fixing unit in the first direction and above the photosensitive member of the image forming unit and the fixing unit in a second direction, wherein the second direction is perpendicular to the first direction, wherein the first feed path forming member has a first through hole formed vertically therethrough, and wherein a first communication path is formed between the communication opening in the tray member and the first through hole in the first feed path forming member.

2. The image forming apparatus according to claim 1, wherein the first feed path forming member is curved such that the first feed path forming member is recessed downward in the second direction, and wherein the first through hole is formed at a lowermost part in the second direction of the first feed path forming member.

3. The image forming apparatus according to claim 1, further comprising a communication member defining the first communication path, wherein the communication member is disposed between the communication opening and the first through hole in the main body, wherein the communication member has a first opening and a second opening, wherein the first opening is provided below the communication opening and is open toward the communication opening, and wherein the second opening is provided above the first through hole and is open toward the first through hole.

4. The image forming apparatus according to claim 3, wherein a cross sectional area of the second opening is smaller than a cross sectional area of the first opening.

5. The image forming apparatus according to claim 3, wherein the communication member includes a duct member configured to discharge air out of the main body.

6. The image forming apparatus according to claim 1, wherein the ejection portion has an ejection opening from which the transferring member is to be ejected out of the main body, and wherein the communication opening is located below the ejection opening in the second direction.

7. The image forming apparatus according to claim 1, further comprising a second feed path forming member disposed below the image forming unit, the first feed path forming member, and the fixing unit in the second direction, the second feed path forming member forming a second feed path, wherein the transferring member is fed along the first feed path from the image forming unit toward the fixing unit, wherein the transferring member having the image fixed on a first side thereof at the fixing unit is supplied again toward the image forming unit along the second feed path, wherein the image forming unit is further configured to form an image on a second side of the transferring member supplied along the second feed path, wherein the second feed path forming member has a second through hole formed vertically therein, and wherein a second communication path is formed between the first through hole in the first feed path forming member and the second through hole in the second feed path forming member.

8. The image forming apparatus according to claim 1, further comprising a storing member disposed in a lower portion of the main body and configured to store the transferring member therein.

9. The image forming apparatus according to claim 1, wherein the image forming unit is configured to form the image on the transferring member while feeding the transferring member from the first end side to the second end side, the first end side being opposite to the second end side in the first direction, wherein the fixing unit is disposed closer to the second end side than the image forming unit is disposed to the second end side, wherein the ejection portion is disposed at the upper end portion of the main body, and wherein the tray member slants upward in a direction from the second end side to the first end side.

* * * * *